US007763847B2

(12) United States Patent
Nishiguchi et al.

(10) Patent No.: US 7,763,847 B2
(45) Date of Patent: Jul. 27, 2010

(54) MASS SPECTROMETER

(75) Inventors: Masaru Nishiguchi, Kyoto (JP); Shinichi Yamaguchi, Kyoto (JP); Michisato Toyoda, Osaka (JP)

(73) Assignees: Shimadzu Corporation, Kyoto (JP); Osaka University, Suita-shi (JP)

( * ) Notice: Subject to any disclaimer, the term of this patent is extended or adjusted under 35 U.S.C. 154(b) by 110 days.

(21) Appl. No.: 11/781,072

(22) Filed: Jul. 20, 2007

(65) Prior Publication Data

US 2008/0197276 A1 Aug. 21, 2008

(30) Foreign Application Priority Data

Jul. 20, 2006 (JP) ..... 2006-197626

(51) Int. Cl.
*H01J 49/06* (2006.01)

(52) U.S. Cl. ..... 250/287; 250/281; 250/282; 250/396 R

(58) Field of Classification Search ..... 250/281, 250/282, 286, 287, 396 R, 397, 396 ML
See application file for complete search history.

(56) References Cited

FOREIGN PATENT DOCUMENTS

JP 11-195398 A 7/1999
JP 2005-79037 A 3/2005

OTHER PUBLICATIONS

Toyoda, et al, "Multi-turn time-of-flight mass spectrometers with electrostatic sectors" J. Mass. Spec. 2003 vol. 38 pp. 1125-1142.*
Michisato Toyoda et al., "Multi-turn time-of-flight mass spectrometers with electrostatic sectors", Journal of Mass Spectrometry, 2003, vol. 38, pp. 1125-1142.
W.P. Poschenrieder, "Multiple-Focusing Time-of-Flight Mass Spectrometers part II. TOFMS With Equal Energy Acceleration", International Journal of Mass Spectrometry and Ion Physics, vol. 9, 1972, pp. 357-373.

* cited by examiner

*Primary Examiner*—Robert Kim
*Assistant Examiner*—Michael Maskell
(74) *Attorney, Agent, or Firm*—Westerman, Hattori, Daniels & Adrian, LLP

(57) ABSTRACT

An ion optical system to form a loop orbit is provided to sufficiently ensure required performance such as ion transmission efficiency while making it easy to design the system by alleviating a space-focusing condition. The loop orbit of the ion optical system is realized so as to satisfy $(t|x)=(t|\alpha)=(t|\delta)=0$ as the time-focusing condition and to satisfy $-2<(x|x)+(\alpha|\alpha)<2$, and $-2<(y|y)+(\beta|\beta)<2$ as the space-focusing condition. $(x|x)$ and other similar terms are constants determined by the elements indicated in the parenthesis in a general expression format of the ion optical system. The conditions are substantially alleviated as opposed to the conventional space-focusing condition where each of $(x|x)$, $(\alpha|\alpha)$, $(y|y)$ and $(\beta|\beta)$ needs to be $\pm 1$. Thus, the parameters to decide the shape of electrodes by which the ion optical system is configured have higher degree of freedom.

2 Claims, 5 Drawing Sheets

| | | |
|---|---|---|
| $\chi_0$ max | 1.0 mm | |
| $\alpha_0$ max | 0.01 | 1000 particles |
| $\gamma_0$ max | 1.0 mm | 10 cycle |
| $\beta_0$ max | 0.01 | Path length 6.490 m |
| $\delta$ max | 0.01 | Ion transmission 99% |

MASS SPECTROMETER

BACKGROUND OF THE INVENTION

The present invention relates to a mass spectrometer, and more specifically to a multi-turn time-of-flight mass spectrometer or a Fourier-transformation mass spectrometer including an ion optical system in which ions are made to fly repeatedly along a closed loop orbit.

In a time-of-flight mass spectrometer (TOF-MS), the mass of an ion is generally calculated from the time of flight which is obtained by measuring a period of time required for the ion to fly at a fixed distance, on the basis of the fact that an ion accelerated by a fixed energy has a flight speed corresponding to the mass of the ion. Accordingly, elongating the flight distance is particularly effective to enhance the mass resolution. However, elongation of a flight distance on a straight line requires unavoidable enlargement of the device, which is not practical, so that a mass spectrometer called a multi-turn time-of-flight mass spectrometer has been developed in order to elongate a flight distance (e.g. refer to Patent Document 1 and Non-Patent Document 1 or other documents).

In such a multi-turn time-of-flight mass spectrometer, the flight distance is effectively elongated by forming a figure-eight "8" shaped closed loop orbit using two to four of the sector-formed electric fields and causing ions to fly along this loop orbit repeatedly multiple times. It has been proved that this construction makes the flight distance free from limitation due to the entire device size and the mass resolution improves as the number of turns increases.

In the multi-turn time-of-flight mass spectrometer as stated earlier, it is necessary to prevent a decrease in the sensitivity and resolution due to temporal and spatial expansion of ions having the same mass to charge ratio during their flight through the loop orbit. Therefore, in designing the ion optical system to define a loop orbit, it is required that the time-of-flight peak should never be broadened and the ion beam should never be diverged after the flight, in addition to the requirement that the orbit should be geometrically and structurally closed.

In order to respond to such demands, it is required as a time-focusing condition that the time of flight of the ions after the flight through the loop orbit is not dependent on an initial position, initial angle, and initial energy of the ions, and further as a space-focusing condition that the position and angle of the ions after the flight have the same state with those of the ions before the flight regardless of the energy, in the multi-turn time-of-flight mass spectrometer described in Patent Document 1 for example. This means that the system needs to satisfy a perfect focusing condition under which the position, direction (or angle) and other parameters of the ions will be perfectly the same before and after the flight through the loop orbit, except for their time-of-flight values, which may differ according to their mass difference. Therefore, even if variations are observed in the initial energy of ions that are introduced into a loop orbit, the same time of flight is obtained as long as the mass to charge ratio remains the same, so that a high mass resolution can be achieved.

However, it is extremely difficult to design an ion optical system which satisfies the aforementioned perfect focusing condition required in the conventional multi-turn time-of-flight mass spectrometer. The design of such an ion optical system, i.e. the selection of the shape and arrangement of electrodes to configure the ion optical system, is generally decided by simulating an ion orbit in a computer by providing incident ions with variations of the initial energy, position and angle or the like, under various conditions including the focusing conditions as previously stated. However, the aforementioned focusing conditions are too strict to locate a physically feasible ion optical system which satisfies the conditions in practice, and since the ion optical systems thereby located have only a small number of variations, there is little design freedom in the present circumstances. Furthermore, the ion optical system thus located has narrow tolerances for the shape and arrangement of the electrodes and other structural dimensions, wherein the mass resolution, sensitivity and other performance tend to significantly decrease unless the ion optical system is fabricated strictly as designed.

An explanation will be made for more details of the focusing conditions in the ion optical system of the aforementioned conventional multi-turn time-of-flight mass spectrometer. Explained first will be a method to express an ion orbit used in the following explanation referring to FIG. 6. Now, suppose that ions are made incident from an incident plane and transported by an ion optical system including sector-formed electric fields and other components so as to be emitted from an emission plane. (A central orbit of ions is drawn by a straight line in FIG. 6 for convenience of explanation.) An ion having a specific energy and a specific mass to charge ratio will exactly follow the central orbit; this ion is defined as a reference ion. If an ion departing from the incident plane initially has deviations from the reference ion in terms of position, flight direction (or angle) and kinetic energy, that ion will have spatial and temporal deviations from the ion that has followed the central orbit when it arrives at the emission plane. Such spatial and temporal deviations can be expressed by first-order approximation equations as follows according to a known theory of ion optical systems:

$$x=(x|x)x_0+(x|\alpha)\alpha_0+(x|\delta)\delta \quad (1)$$

$$\alpha=(\alpha|x)x_0+(\alpha|\alpha)\alpha_0+(\alpha|\delta)\delta \quad (2)$$

$$y=(y|y)y_0+(y|\beta)\beta_0 \quad (3)$$

$$\beta=(\beta|y)y_0+(\beta|\beta)\beta_0 \quad (4)$$

$$t=(t|x)x_0+(t|\alpha)\alpha_0+(t|\delta)\delta \quad (5)$$

Here, $x_0$ and $\alpha_0$ are, respectively, an amount of deviation of a position in a direction orthogonal to the central orbit and that of an angle (or flight direction) to the central orbit within the loop orbit plane at the incident plane. The parameters $y_0$ and $\beta_0$ are, respectively, an amount of deviation of a position in a direction orthogonal to the central orbit and that of an angle to the central orbit within a plane perpendicular to the loop orbit plane at the incident plane. The parameters x and $\alpha$ are, respectively, an amount of deviation of a position in a direction orthogonal to the central orbit and that of an angle to the central orbit within the loop orbit plane at the emission plane. The parameters y and $\beta$ are, respectively, an amount of deviation of a position in a direction orthogonal to the central orbit and that of an angle to the central orbit within a plane perpendicular to the loop orbit plane at the emission plane. The parameter $\delta$ is an amount of deviation of energy at the incident plane. The parameter t expresses an amount of deviation (i.e. advance and delay) in the flight distance of a given ion from the reference ion in a direction parallel to the central orbit, and corresponds to a deviation in the time of flight from the reference ion. Moreover, $(x|x)$, $(x|\alpha)$, $(x|\delta)$, $(\alpha|x)$, $(\alpha|\alpha)$, $(\alpha|\delta)$, $(y|y)$, $(y|\beta)$, $(\beta|y)$, $(\beta|\beta)$, $(t|x)$, $(t|\alpha)$, and $(t|\delta)$ are constants of the ion optical system, each determined by the elements indicated in the parenthesis. These constants represent the characteristics of the ion optical system.

An ion optical system in a time-of-flight mass spectrometer having an orbit of a closed curve (i.e. closed orbit) as proposed in Non-Patent Document 1 will be considered. In such an ion optical system, an ion that has departed from an incident point will ideally return to this incident point again after flying on the aforementioned closed orbit. To have such a closed orbit, the ion optical system must satisfy the following equations, which are regarded as a required time-focusing condition:

$$(t|x)=0 \quad (6)$$

$$(t|\alpha)=0 \quad (7)$$

$$(t|\delta)=0 \quad (8)$$

Meanwhile, the system must also have the spatial characteristics expressed by the following equations, which are regarded as a required space-focusing condition:

$$(x|x)=\pm 1 \quad (9)$$

$$(x|\alpha)=0 \quad (10)$$

$$(x|\delta)=0 \quad (11)$$

$$(\alpha|x)=0 \quad (12)$$

$$(\alpha|\alpha)=\pm 1 \quad (13)$$

$$(\alpha|\delta)=0 \quad (14)$$

$$(y|y)=\pm 1 \quad (15)$$

$$(y|\beta)=0 \quad (16)$$

$$(\beta|y)=0 \quad (17)$$

$$(\beta|\beta)=\pm 1 \quad (18)$$

If the time- and space-focusing conditions are both satisfied, the time of flight of ions flying on the aforementioned closed orbit is exclusively dependant on the mass of the ions without being influenced by the position, angle and kinetic energy of the ions.

The aforementioned focusing conditions are an ideal condition, and the time-focusing condition expressed by the equations (6) to (8) is relatively easy to satisfy in general but the entire space-focusing condition expressed by the equations (9) to (18) is extremely difficult to satisfy. It is also relatively easy to realize that some of the conditions expressed by the above equations (6) to (18) are derived by providing a geometry structure of an ion optical system with double symmetry as described in Patent Document 1. However, satisfying the geometrical conditions for creating a double symmetrical structure decreases the number of parameters relating to the components of the ion optical system, thereby design freedom is reduced. Thus, it cannot be expected that the probability of finding out an appropriate ion optical system as a solution will be higher.

The same problem as stated previously applies to not only the configuration where ions are detected after flying along a loop orbit a predetermined number of times, but also a so-called Fourier-transformation mass spectrometer, in which ions are made to fly along a loop orbit and repeatedly detected by a non-destructive ion detector (or a detector for detecting ions by partially separating ions) in the middle of the flight through the loop orbit so that a mass to charge ratio of the ions is calculated by Fourier-transforming the detection signals obtained in every turn of the ions (e.g. refer to Patent Document 2).

Patent Document 1: Japanese Unexamined Patent Application Publication No. H11-195398

Patent Document 2: Japanese Unexamined Patent Application Publication No. 2005-79037

Non-Patent Document 1: Michisato TOYODA et al. "Multi-turn time-of-flight mass spectrometers with electrostatic sectors", Journal of Mass Spectrometry, 2003, 38, pp. 1125-1142

Non-Patent Document 2: W. P. Poshenrieder, "Multiple-Focusing Time-Of-Flight Mass Spectrometers Part II TOFMS With Equal Energy Acceleration", Int. J. Mass. Spectrom. Ion Phys., 9 (1972)

SUMMARY OF THE INVENTION

The present invention has been achieved in view of the aforementioned problems, and a main objective thereof is to provide a multi-turn time-of-flight mass spectrometer or a Fourier-transformation mass spectrometer wherein design freedom is enhanced while design complications are resolved by making it easy to locate an ion optical system adapted to the conditions concerned.

In order to solve the aforementioned problems, the present inventors have devised a space-focusing condition from a viewpoint of a stable condition of an orbit with respect to a dynamic system having a periodic boundary condition, as a different approach from that of the conventional technique. This condition corresponds to a stable condition of a solution of the Mathieu equation, which is used for evaluating the orbit stability of ions trapped by an ion trap or other devices in which ions are trapped by, for example, an electric field (refer to Japanese Unexamined Patent Application Publication No. 2003-16991 or other documents). In this case, a stable condition of a solution of the Mathieu equation can be expressed by a stability diagram, wherein a condition is set so that the behavior of ions falls in a stable region which is clearly distinguished from an unstable region (i.e. divergent region), and a space-focusing condition of an ion optical system is similarly set so that ions flying along the loop orbit are included in the stable region of the stability diagram.

That is, to solve the previously described problems, the present invention provides a multi-turn time-of-flight mass spectrometer or a Fourier-transformation mass spectrometer, in which ions are made to fly along a closed loop orbit repeatedly by effects of electric fields including a plurality of sector-formed electric fields so as to separate the ions in accordance with their mass to charge ratios, wherein the loop orbit, which is created by an ion optical system generating the electric fields, satisfies the following equation as the time-focusing condition:

$$(t|x)=(t|\alpha)=(t|\delta)=0 \quad (19)$$

and also satisfies the following equations as the space-focusing condition:

$$-2<(x|x)+(\alpha|\alpha)<2 \quad (20)$$

$$-2<(y|y)+(\beta|\beta)<2 \quad (21).$$

The method of describing the ion orbit in the present ion optical system is the same as explained earlier.

In the mass-spectrometer according to the present invention, the equation (19) which is the time-focusing condition in the ion optical system is equivalent to the equations (6), (7) and (8) of the conventional time-focusing condition. Meanwhile, the space-focusing condition is realized by a substantially reduced number of conditions that are less strict in comparison with the equations (9) to (18) of the conventional time-focusing condition. The condition defined by the equations (20) and (21) corresponds to a condition for a solution to be within a stable region expressing a stable condition of a solution of the Mathieu equation as stated earlier. In contrast, the conventional condition intended for the perfect focusing can be interpreted as a very strict condition: the solution should be positioned on a boundary line to an unstable region in this stable region. Such a condition is hard to satisfy. Moreover, the strict condition makes it easier for ions to undesirably move into the unstable region due to mounting errors of the ion optical system. This is probably the reason for the narrowness of the tolerances for the shape and arrangement of the electrodes and other structural dimensions.

On the contrary, according to the ion optical system of the mass spectrometer according to the present invention, a stable condition of a loop orbit is substantially alleviated in comparison with that of the conventional technique, making it easier to locate an ion optical system adapted to the condition, providing easier orbit design and enhancing design freedom, so that an ion optical system adapted to specifications such as an entire device size can be easily provided. The tolerances for the shape and position of the electrodes and other structural dimensions of the ion optical system can be widened without causing a decrease in the performance, which is advantageous to the reduction of manufacturing costs.

EXPLANATION OF THE NUMERALS

Figure 1:
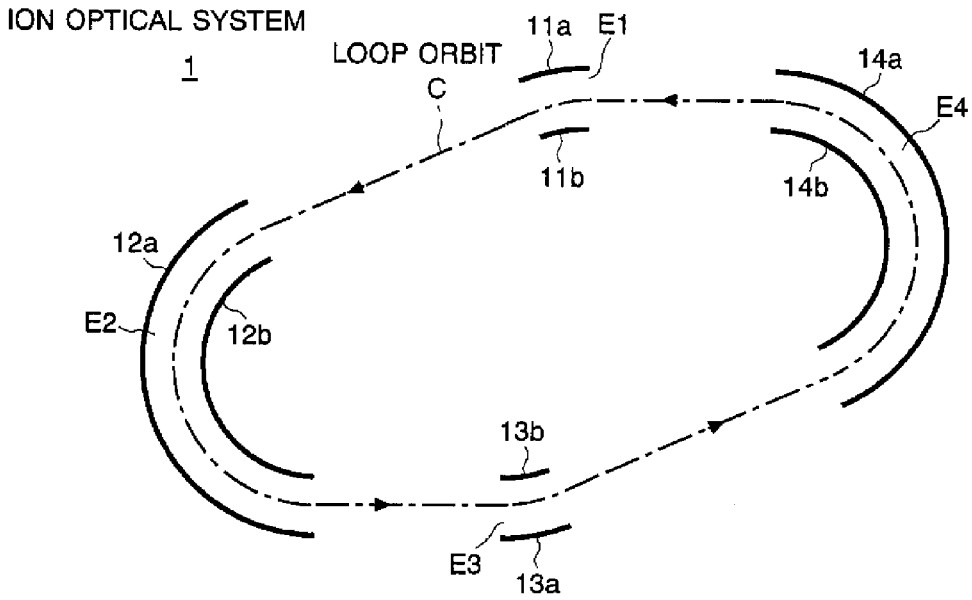
FIG. 1 is a schematic top view of an ion optical system of a multi-turn time-of-flight mass spectrometer according to a first embodiment of the present invention.

1 . . . Ion Optical System
E1, E2, E3, E4 . . . Toroidal Sector-Formed Electric Field
2 . . . Nondestructive Ion Detector
C . . . Loop Orbit

DETAILED DESCRIPTION OF A PREFERRED EMBODIMENT

First Embodiment

An explanation will be made for a multi-turn time-of-flight mass spectrometer as one embodiment (i.e. first embodiment) of the present invention referring to the drawings. The ion optical system in the mass spectrometer of the present embodiment was designed so that it satisfies the following equation as the time-focusing condition:

$$(t|x)=(t|\alpha)=(t|\delta)=0 \tag{19}$$

and satisfies the following equations as the space-focusing condition:

$$-2<(x|x)+(\alpha|\alpha)<2 \tag{20}$$

$$-2<(y|y)+(\beta|\beta)<2 \tag{21}$$

The loop orbit was formed by four of the first to fourth toroidal sector-formed electric fields. To create a geometric structure having double symmetry, the first toroidal sector-formed electric field and the third toroidal sector-formed electric field were made to have the same shape and the second toroidal sector-formed electric field and the fourth toroidal sector-formed electric field are also made to have the same shape. Under these conditions, the parameter settings for each electric field were explored.

Figure 2:
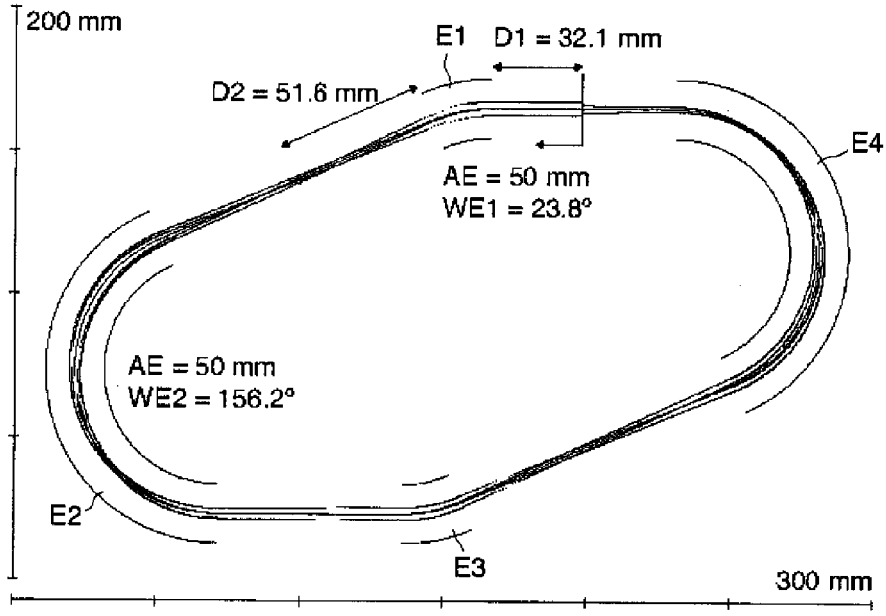
FIG. 2 is a top view of the computer-simulated flight orbits of ions differing in initial position and angle in the ion optical system of the preset embodiment.

FIG. 1 is a schematic top view of the ion optical system 1 in the mass spectrometer of the present embodiment, and FIG. 2 is a top view of the computer-simulated flight orbits of ions differing in initial position and angle in the ion optical system 1. In the ion optical system 1, the first toroidal sector-formed electric field E1 is formed by a first electrode 11 consisting of an external electrode 11*a* paired with an internal electrode 11*b*; the second toroidal sector-formed electric field E2 is formed by a second electrode 12 consisting of an external electrode 12*a* paired with an internal electrode 12*b*; the third toroidal sector-formed electric field E3 is formed by a third electrode 13 consisting of an external electrode 13*a* and an internal electrode 13*b*; and the fourth toroidal sector-formed electric field E4 is formed by a fourth electrode 14 consisting of an external electrode 14*a* paired with an internal electrode 14*b*. The four electric fields E1 to E4 form a loop orbit (i.e. the central orbit) C. Though it is not shown, an incident gate electrode and an emission gate electrode are disposed at appropriate positions along the loop orbit C. The incident gate electrode is used to bring externally generated ions onto the loop orbit C. The emission gate electrode is used to make the ions flying along the loop orbit C deviate from the loop orbit C and be introduced to an ion detector (not shown).

The first and third toroidal sector-formed electric fields E1 and E3 have a central orbit radius of 50 mm, a deflection angle of 23.8 degrees, and a C value of 0.0274, while the second and fourth toroidal sector-formed electric fields E2 and E4 have a central orbit radius of 50 mm, a deflection angle of 156.2 degrees, and a C value of 0.0274. A free flight space between the fourth toroidal sector-formed electric field E4 and the first toroidal sector-formed electric field E1 has a distance D1 of 32.1 mm, and a free flight space between the first toroidal sector-formed electric field E1 and the second toroidal sector-formed electric field E2 has a distance D2 of 51.6 mm, wherein one-cycle flight distance of the loop orbit C is 64.9 cm. The C value is a value defined by $C=r_0/R$, where $r_0$ is the radius of the central orbit and R is the curvature radius of an equipotential surface within a plane orthogonal to the central orbit.

The constants that describe the ion optical characteristics of the ion optical system 1 after one turn of the ions have the values to be listed later. Those values confirm that the present ion optical system satisfies both the time-focusing condition based on the equation (19) and the space-focusing condition based on the equations (20) and (21). Meanwhile, in light of the conventional space-focusing condition expressed by the equations (9) to (18), it is understood that the ion optical system does not satisfy these conditions and cannot be locate by the conventional method for designing an optical system (i.e. excluded as being unsuitable for the conditions).

Figure 3:
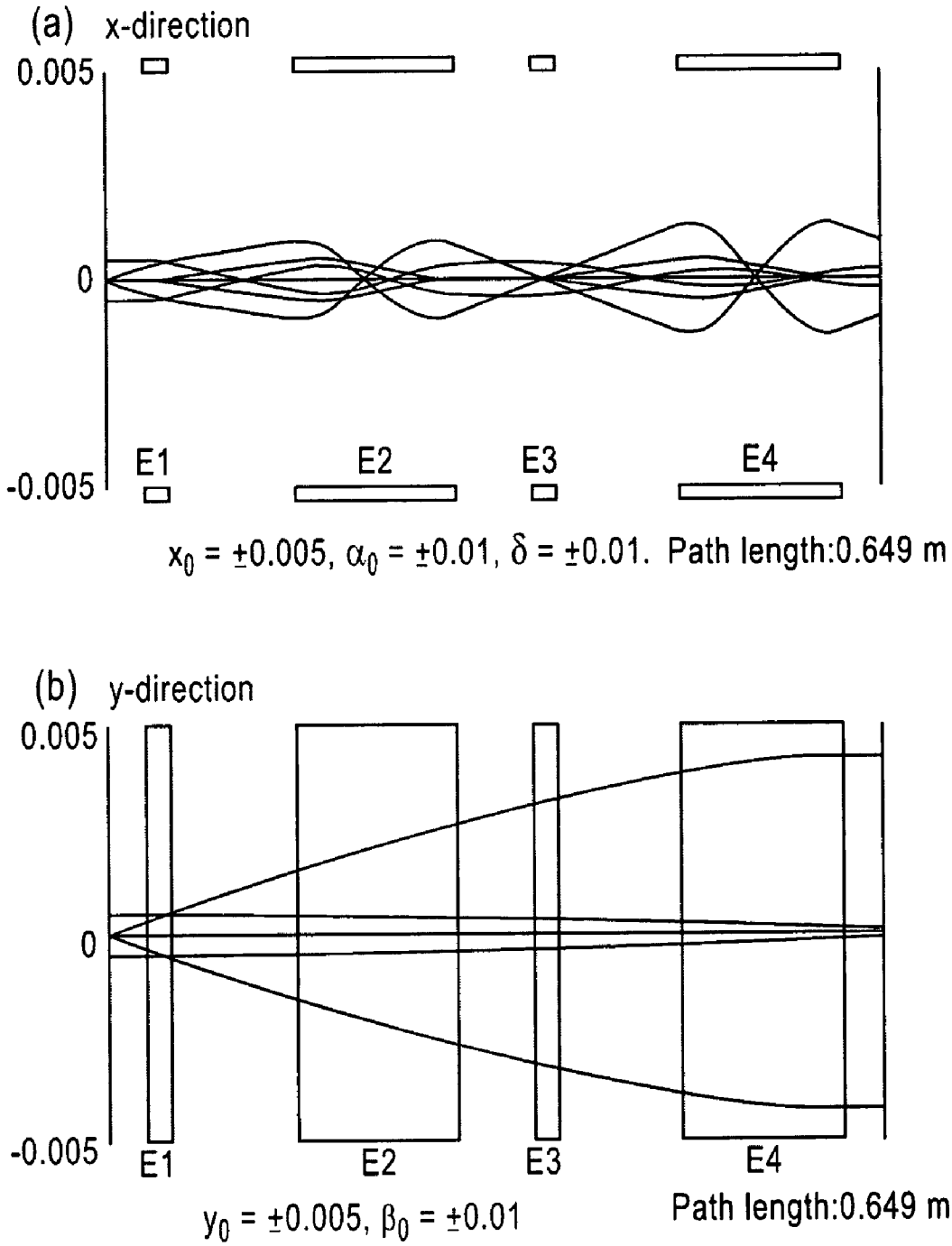
FIGS. 3(*a*) and 3(*b*) show the result of simulating an ion orbit by first order approximation in the x-direction and the y-direction in the ion optical system of the present embodiment.
Figure 4:
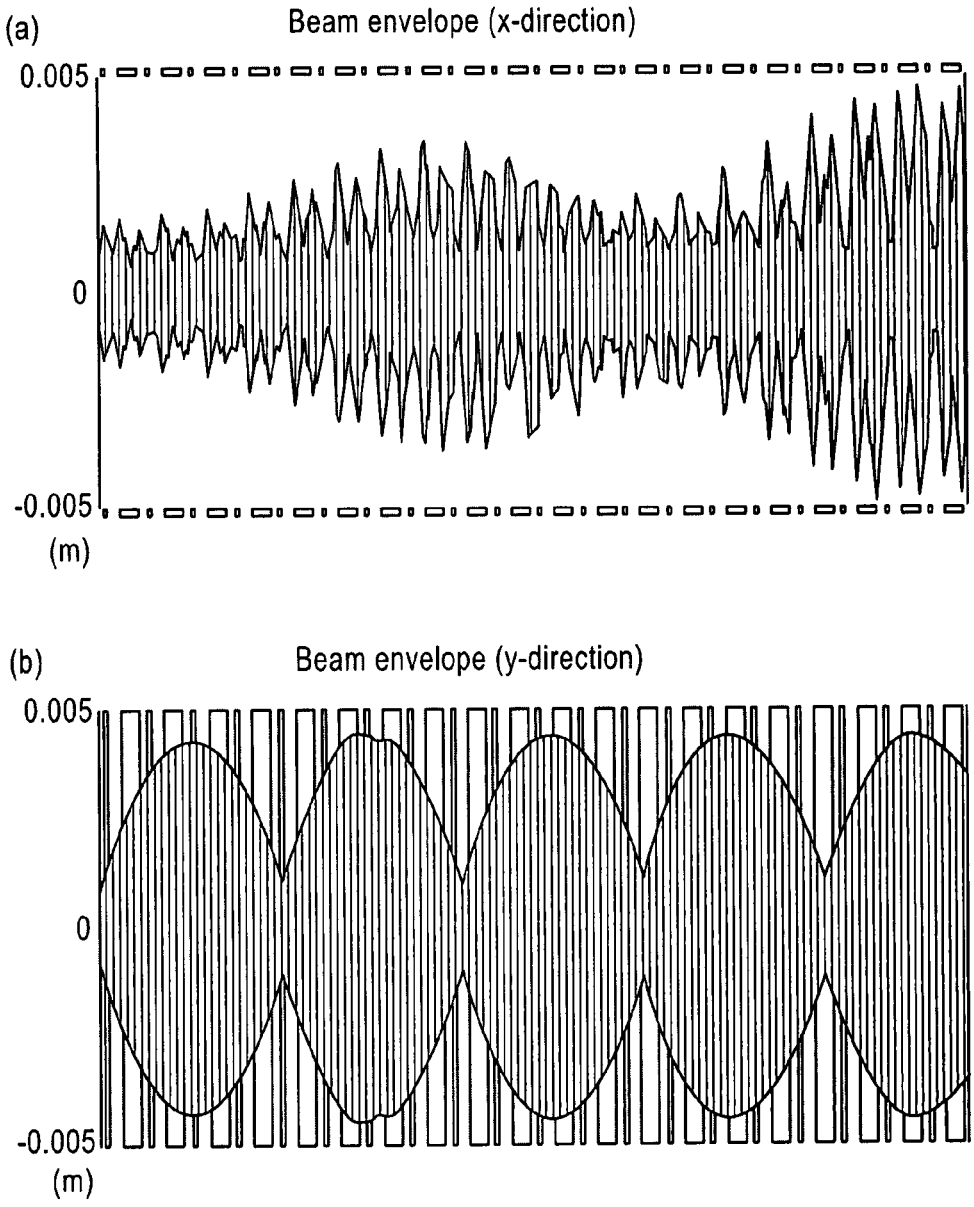
FIGS. 4(*a*) and 4(*b*) show the result of simulating beam envelops by third-order approximation in the x-direction and the y-direction after the tenth turn of the ions.
Figure 5:
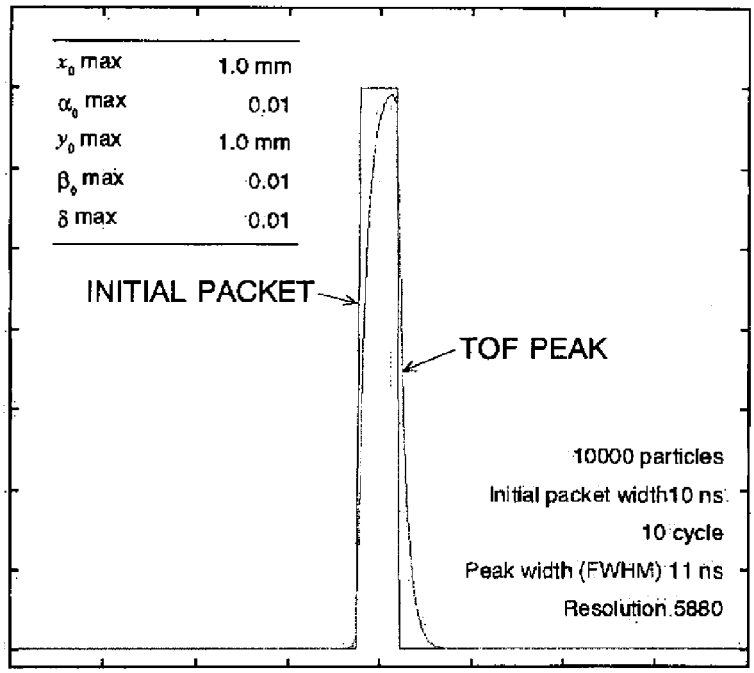
FIG. 5 shows the result of simulating a TOF peak after the tenth turn of the ions.
Figure 6:
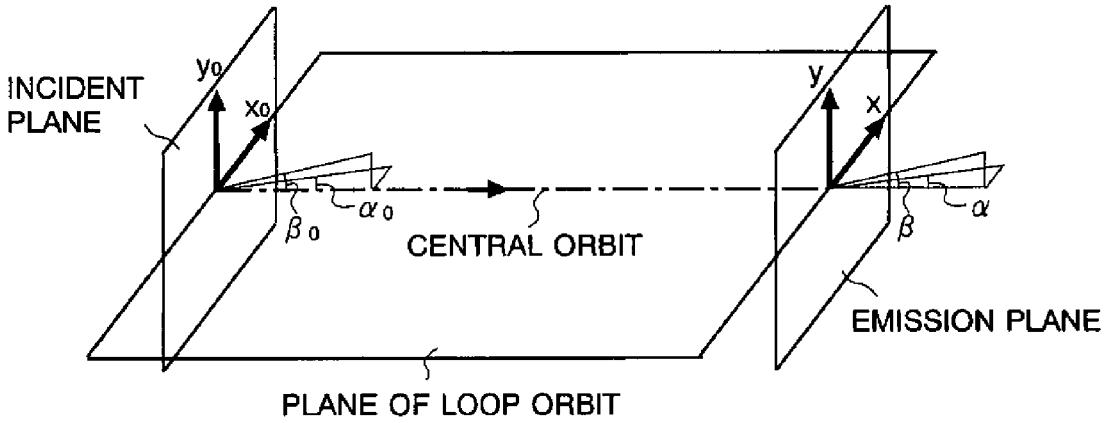
FIG. 6 is an explanatory view of a method of describing an ion optical system.

$(x|x)=0.5175$ $(\alpha|\alpha)=1.1046$ $(x|x)+(\alpha|\alpha)=1.6221$ $(x|\delta)=0$ $(y|y)=0.1626$ $(\beta|\beta)=-0.0239$ $(y|y)+(\beta|\beta)=0.1387$ $(t|x)=0.0004$ $(t|\alpha)=0.0000$ $(t\delta)=0.0001$ FIG. 3 is a view showing the result of simulating an ion orbit by first order approximation in the x-direction (within a horizontal plane) and the y-direction (or vertical direction) in the ion optical system 1 of the present embodiment. It is understood that orbit elongation is suppressed to about ±5 mm in the y direction. FIG. 4 is a view showing the result of simulating beam envelops by third-order approximation in the x direction and the y direction after the tenth turn of the ions, wherein an ion orbit of 1000 particles was traced. FIG. 5 is a diagram showing the result of simulating a TOF peak at this time. It was observed that ions hardly collided with the electrodes even during the ten turns of the ions as stated earlier, and an ion transmittance ratio equal to or larger than 99% is achieved. Moreover, a peak width in the time of flight is 11 nanoseconds and a mass resolution is 5880 after the tenth turn of the ions with respect to an initial packet width of 10 nanoseconds, which means that an effect to suppress an increase in the peak width is sufficiently high.

As stated previously, it is understood that the ion optical system according to the present embodiment is capable of achieving a high ion transmission efficiency and effectively suppressing an increase in the peak width in spite of being designed under the space-focusing condition which is substantially alleviated in comparison with that of the conventional technique.

Second Embodiment

Figure 7:
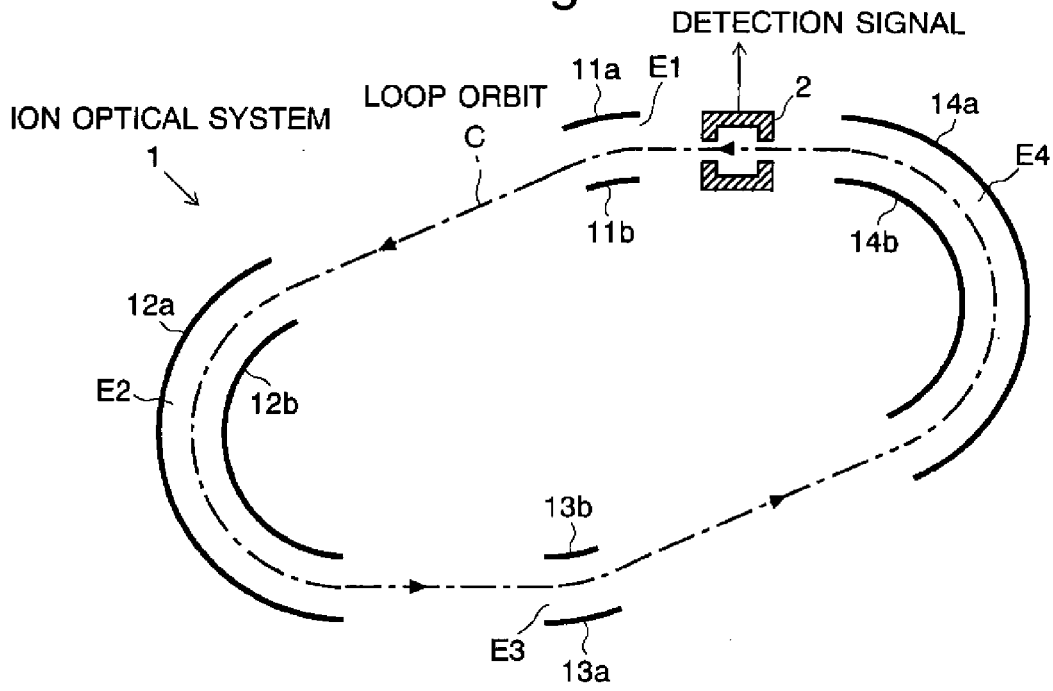
FIG. 7 is a schematic top view of the ion optical system of a Fourier-transformation mass spectrometer according to another embodiment of the present invention.

Explained next will be another embodiment (i.e. second embodiment) of the present invention with reference to the drawings. In the present embodiment, the ion optical system 1 explained in the first embodiment is applied to a Fourier-transformation mass spectrometer. FIG. 7 is a schematic top view of the ion optical system 1 in the mass spectrometer of the present embodiment, and FIG. 8 is a view showing one example of a time-of-flight spectrum created in the present device.

This Fourier-transformation mass spectrometer is provided with a detector 2 of an ion non-destructive type in the middle of the loop orbit C as shown in FIG. 7. This detector 2 outputs an electric signal corresponding to an amount of passing ions, i.e. a kind of electrically charged particles, by using electromagnetic induction or other electrical effects. Now, suppose that ions are made to turn N times along the loop orbit C. In this case, the ion passes through the detector 2 in every cycle of the loop orbit C. Therefore, if a time-of-flight spectrum of an ion having a certain mass is created from the signals detected by the detector 2, the spectrum will be as shown in FIG. 8(*a*), where a peak appears in each turn of the ion.

In this ion optical system 1, even if ions having the same mass are initially dispersed in terms of kinetic energy, their time-of-flight values will be converged, so that the time-of-flight spectrum as shown in FIG. 3(*a*) will have peaks at approximately equal intervals. Accordingly, it can be regarded as a waveform of signals having certain one frequency f. This frequency f can be calculated by Fourier-transforming the time-of-flight spectrum data to transformation the time axis into a wavelength axis. From the frequency f, the mass to charge ratio of the ion can be calculated by a known method, such as disclosed in Patent Document 2.

Figure 8:
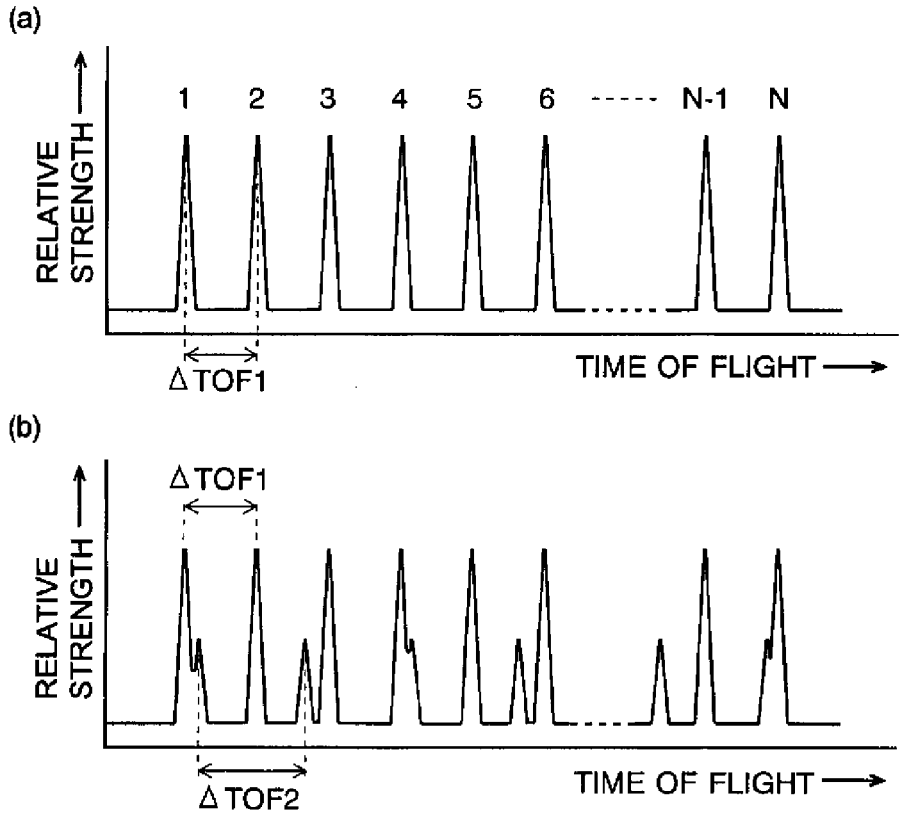
FIG. 8 shows one example of a time-of-flight spectrum created by the device of FIG. 7.

If measurements are made in a state where two kinds of ions having different mass to charge ratios are mixed, a time-of-flight spectrum as shown in FIG. 8(*b*) is obtained, wherein peaks having a different generation interval (ΔTOF1 and ΔTOF2) are partially overlapped and a peak appears in a frequency corresponding to each of the ion species even in this case by Fourier transforming the time-of-flight spectrum data, so that a mass to charge ratio can be easily calculated from the frequency.

The detector 2 used in the Fourier-transformation mass spectrometer may not be genuinely ion-non-destructive; it may be a detector that detects ions by partially separating (or consuming) the ions every time they pass through it. In this case, an amount of ions flying along the loop orbit C is gradually reduced and thereby the number of turns is limited. However, this causes no problem as long as a sufficient number of turns can be obtained so that the Fourier transformation operation can be accurately performed.

Any of the aforementioned embodiments are merely an embodiment of the present invention, and it is clear that any modifications, changes and additions to be made appropriately within the scope of the present invention are also included in the scope of the patent claims of the present application.

What is claimed is:

1. A multi-turn time-of-flight mass spectrometer or a Fourier-transformation mass spectrometer including an ion optical system for generating electric fields, in which ions are made to fly along a closed loop orbit repeatedly by effects of the electric fields so as to separate the ions in accordance with their mass to charge ratios, wherein:

the ion optical system comprises a first sector-shaped electric field, a second sector-shaped electric field, a third sector-shaped electric field, and a fourth sector-shaped electric field, where the first and third sector-shaped electric fields have a deflection angle of 23.8 degrees, and a C value of 0.0274, while the second and fourth sector-shaped electric fields have a deflection angle of 156.2 degrees, and a C value of 0.0274, where the C value is a value defined by $C=r_0/R$, $r_0$ being a radius of a central orbit as an orbit of a reference ion having a specific energy, and R being a curvature radius of an equipotential surface within a plane orthogonal to the central orbit, and a free flight space between the fourth sector-shaped electric field and the first sector-shaped electric field has a distance of $1.2854r_0$, and a free flight space between the first sector-shaped electric field and the second sector-shaped electric field has a distance of $2.064r_0$; and the ion optical system creates a loop orbit that satisfies the following equation as a time-focusing condition:

$$(t|x)=(t|\alpha)=(t|\delta)=0$$

where the ion orbit in the ion optical system are expressed by a following method:

it is assumed that ions are made incident from an incident plane, transported by the ion optical system, and emitted from an emission plane;

an ion made incident from the incident plane with an initial value different from that of the reference ion has a displacement from the central orbit on the emission plane; and the displacement is expressed by following first-order approximation equations:

$$x=(x|x)x_0+(x|\alpha)\alpha_0+(x|\delta)\delta$$

$$\alpha=(\alpha|x)x_0+(\alpha|\alpha)\alpha_0+(\alpha|\delta)\delta$$

$$y=(y|y)y_0+(y|\beta)\beta_0$$

$$\beta=(\beta|y)y_0+(\beta|\beta)\beta_0$$

$$t=(t|x)x_0+(t|\alpha)\alpha_0+(t|\delta)\delta$$

using $x_0$ and $\alpha_0$ as, respectively, an amount of deviation of a position in a direction orthogonal to the central orbit and an amount of deviation of an angle or flight direction to the central orbit within the loop orbit plane at the incident plane; $y_0$ and $\beta_0$ as, respectively, an amount of deviation of a position in a direction orthogonal to the central orbit and an amount of deviation of an angle to the central orbit within a plane perpendicular to the loop orbit plane at the incident plane; x and $\alpha$ as, respectively, an amount of deviation of a position in a direction orthogonal to the central orbit and an amount of deviation of an angle to the central orbit within the loop orbit plane at the emission plane; y and $\beta$ as, respectively, an amount of deviation of a position in a direction orthogonal to the central orbit and an amount of deviation of an angle to the central orbit within a plane perpendicular to the loop orbit plane at the emission plane; $\delta$ as an amount of deviation of energy at the incident plane; t to express an amount of deviation in the flight distance of a given ion from the reference ion in a direction parallel to the central orbit which corresponds to a deviation from the reference ion in the time of flight; and $(x|x)$, $(x|\alpha)$, $(x|\delta)$, $(\alpha|x)$, $(\alpha|\alpha)$, $(\alpha|\delta)$, $(y|y)$, $(y|\beta)$, $(\beta|y)$, $(\beta|\beta)$, $(t|x)$, $(t|\alpha)$ and $(t|\delta)$ as constants of the ion optical system, each determined by elements indicated in parenthesis, where the constants represent characteristics of the ion optical system.

2. The multi-turn time-of-flight mass spectrometer or a Fourier-transformation mass spectrometer according to claim 1, wherein the ion optical system creates the loop orbit that further satisfies the following equations as a space-focusing condition:

$$0<|(x|x)+(\alpha|\alpha)|<2$$

$$0<|(y|y)+(\beta|\beta)|<2.$$

* * * * *